US005947389A

United States Patent [19]

Hasegawa et al.

[11] Patent Number: 5,947,389

[45] Date of Patent: Sep. 7, 1999

[54] VARIABLE NOZZLE HOLE TYPE FUEL INJECTION NOZZLE

[75] Inventors: Toshiyuki Hasegawa; Shinya Wozaki; Takeshi Miyamoto; Masanori Amemori; Takashi Kobayashi, all of Higashimatsuyama, Japan

[73] Assignee: Zexel Corporation, Tokyo, Japan

[21] Appl. No.: 08/945,660

[22] PCT Filed: Jun. 6, 1996

[86] PCT No.: PCT/JP96/01536

§ 371 Date: Oct. 24, 1997

§ 102(e) Date: Oct. 24, 1997

[87] PCT Pub. No.: WO96/41948

PCT Pub. Date: Dec. 27, 1996

[51] Int. Cl.[6] ..... F02M 61/18

[52] U.S. Cl. ..... 239/533.2; 239/533.3; 239/533.4; 239/533.9; 239/581.2

[58] Field of Search ..... 239/533.1, 533.2, 239/533.3, 533.4, 533.9, 533.11, 533.12, 581.1, 581.2

[56] References Cited

U.S. PATENT DOCUMENTS

| | | | |
|---|---|---|---|
| 5,020,500 | 6/1991 | Kelly | 123/467 |
| 5,119,647 | 6/1992 | Yoshizu | 239/533.12 |

FOREIGN PATENT DOCUMENTS

| | | |
|---|---|---|
| S59-200063 | 11/1984 | Japan . |
| 60-22071 | 4/1985 | Japan . |
| H4-76266 | 3/1992 | Japan . |
| H6-241142 | 8/1994 | Japan . |
| 7-303366 | 6/1995 | Japan . |

*Primary Examiner*—Andres Kashnikow
*Assistant Examiner*—Robin O. Evans
*Attorney, Agent, or Firm*—Michael J. Striker

[57] ABSTRACT

In fuel injection nozzle for injecting fuel into an internal combustion engine of a type wherein a well is provided in the tip of a nozzle body and a rotary valve is disposed in the well and the area of nozzle holes formed in the enclosing wall bounding the well is changed by changing the angle of this rotary valve, the enclosing wall bounding the well has a conical surface and the rotary valve has at its upper end a pressure-receiving surface for receiving the pressure of pressurized fuel and has at its periphery a conical surface of an angle matching the angle of the conical surface of the enclosing wall and a plurality of fuel passages having one end opening at the pressure-receiving surface are provided spaced in the circumferential direction in the rotary valve and the fuel passages open at a portion of the conical surface of the rotary valve facing the nozzle holes. As a result, a frictional holding torque overcoming a torque tending to rotate the rotary valve is provided so that the rotary valve is fixed in position by the fuel injection pressure only.

10 Claims, 13 Drawing Sheets

FIG. 3
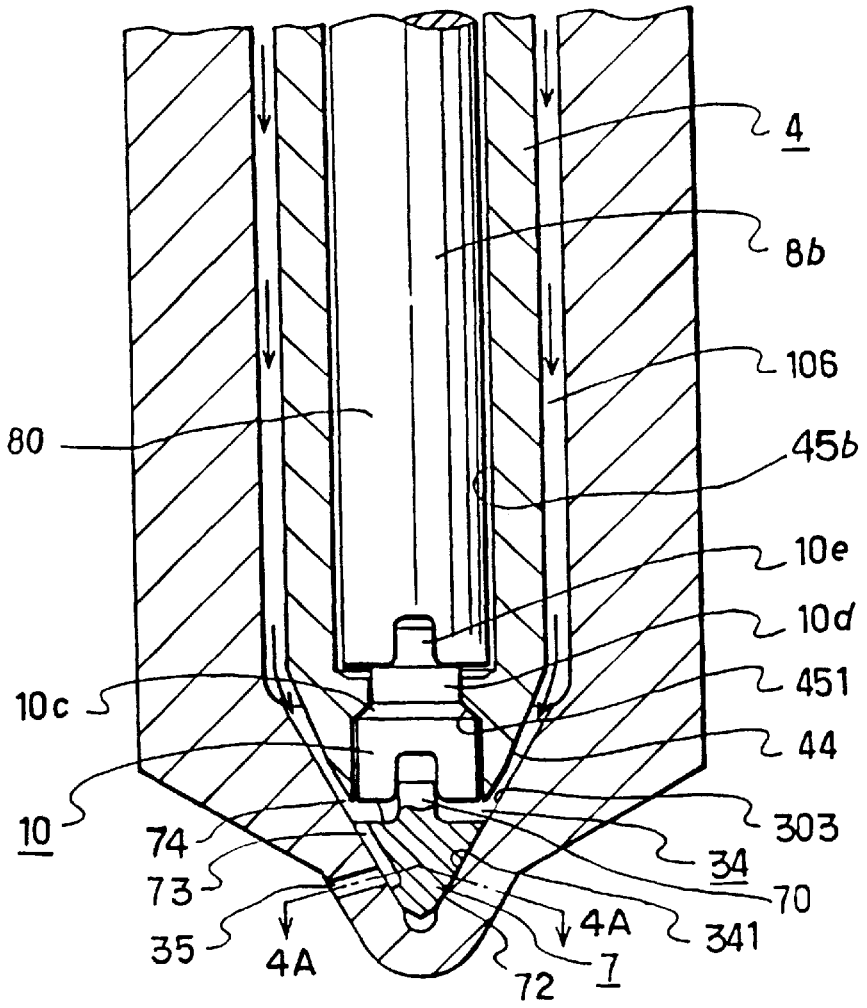
FIG. 3-A
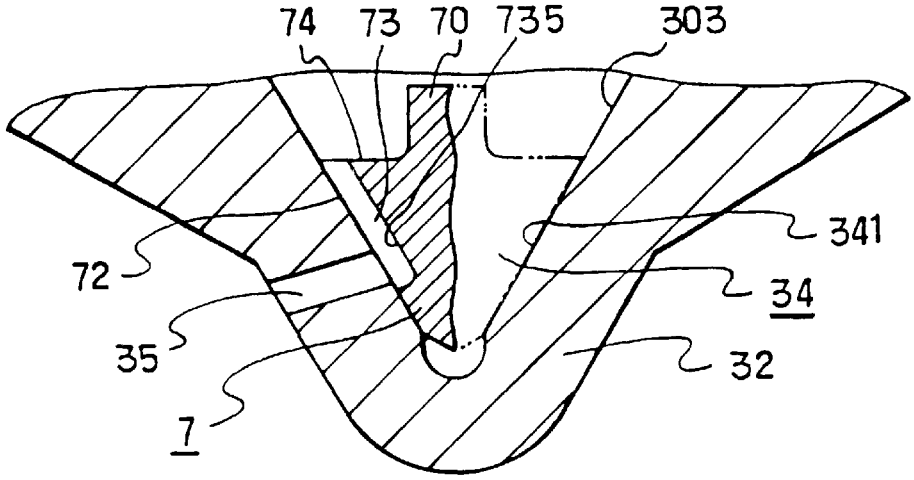

FIG. 4-A
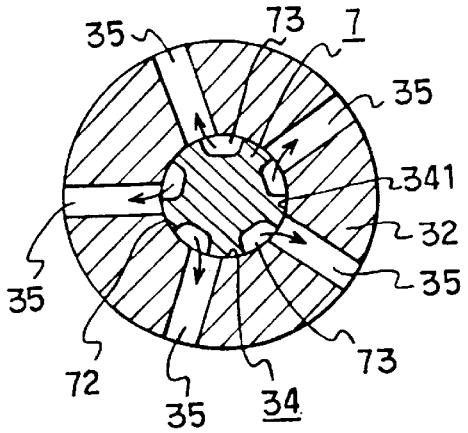
FIG. 4-B
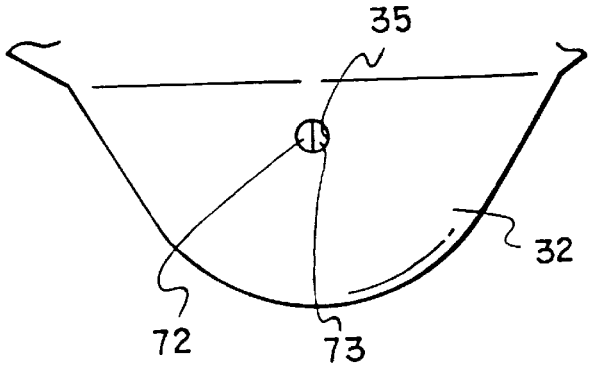
FIG. 5-A
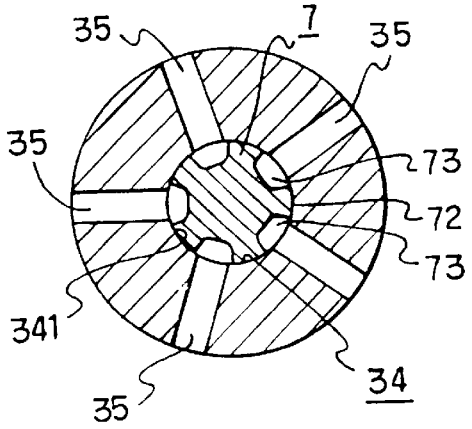
FIG. 5-B
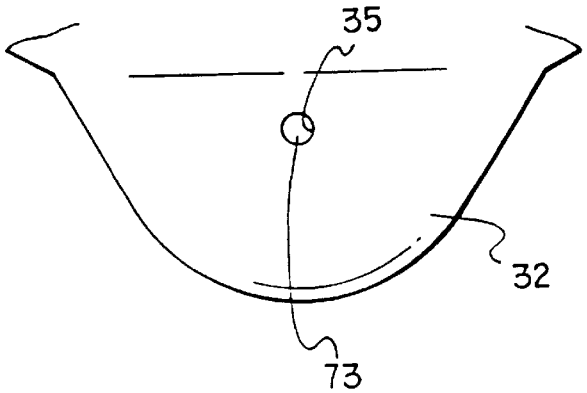

FIG. 9
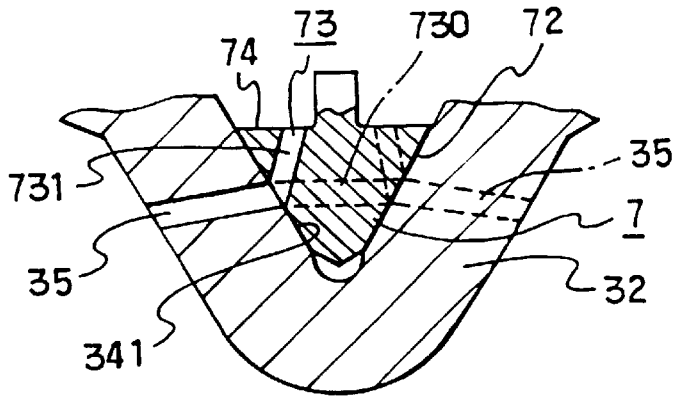
FIG.10
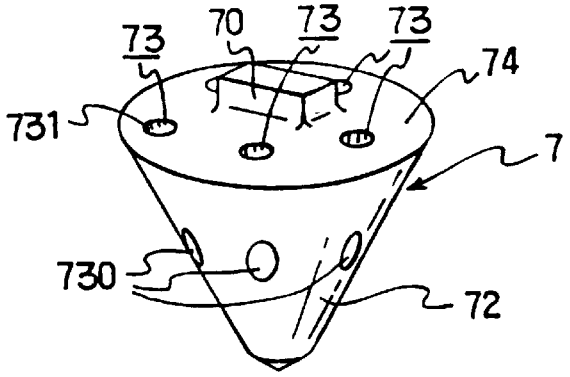
FIG.11-A
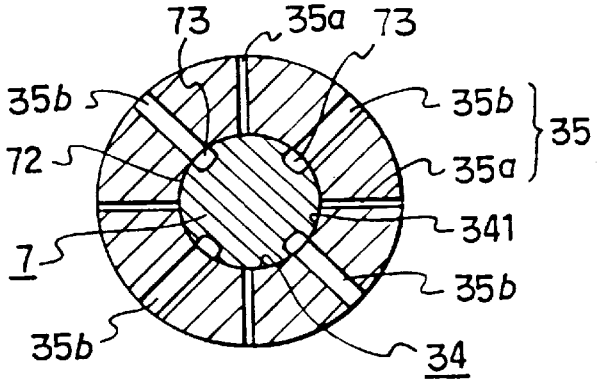
FIG.11-B
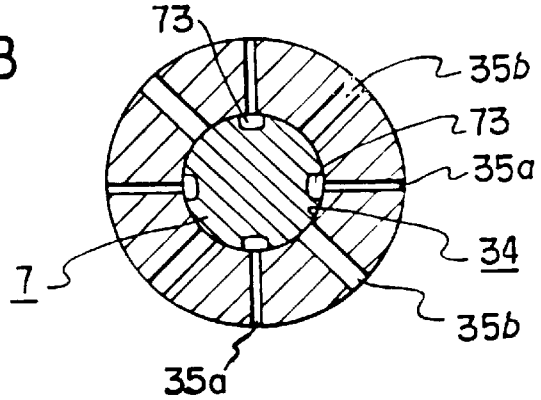

FIG. 12
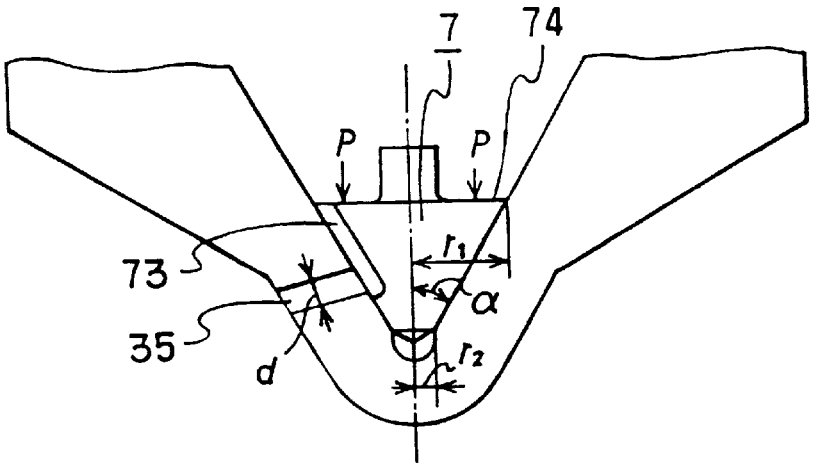
FIG. 12-A
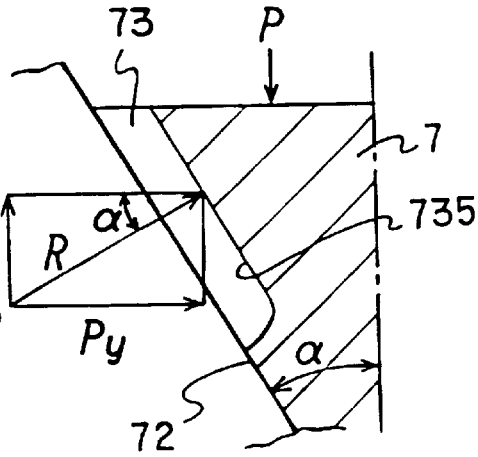
FIG. 13
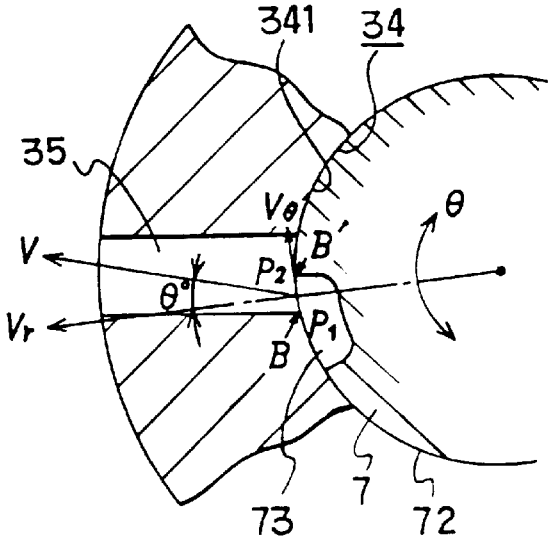

FIG.18-A
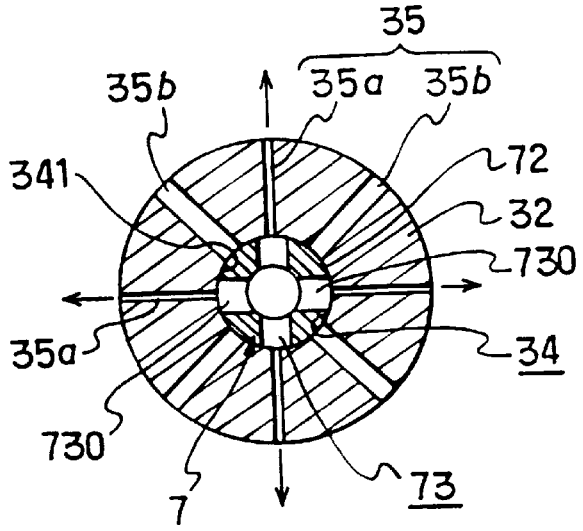
FIG.18-B
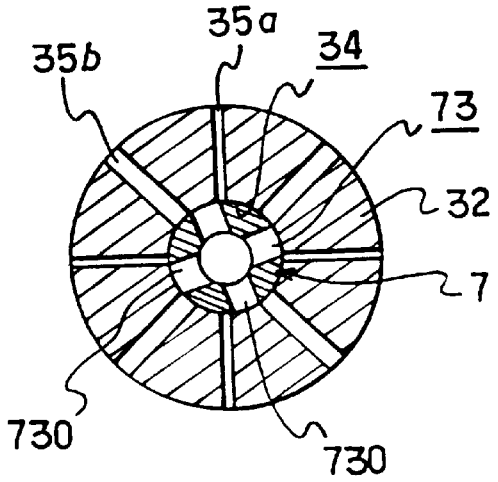
FIG.18-C
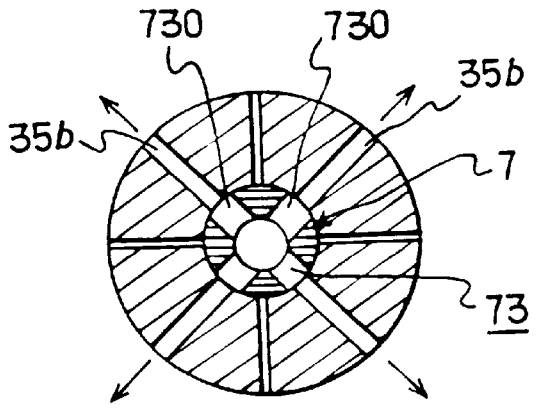

FIG.19
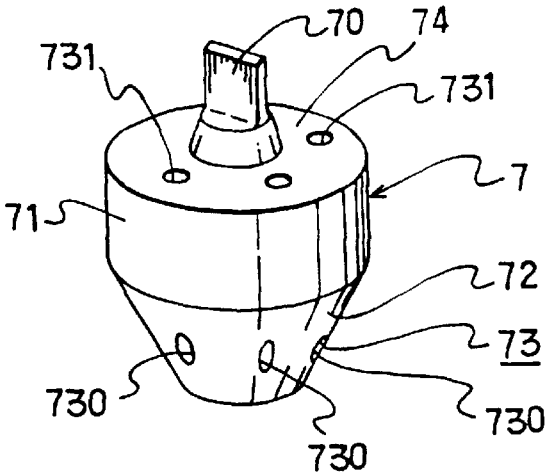
FIG. 20-A
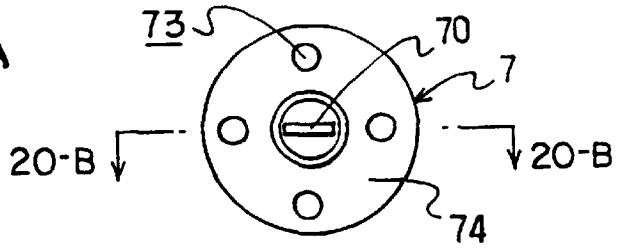
FIG. 20-B
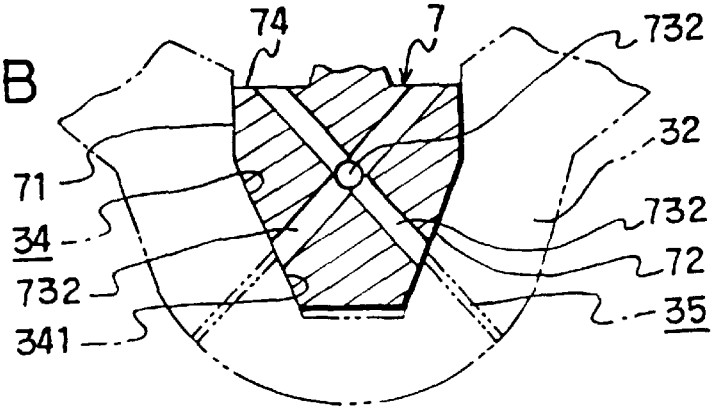
FIG. 21
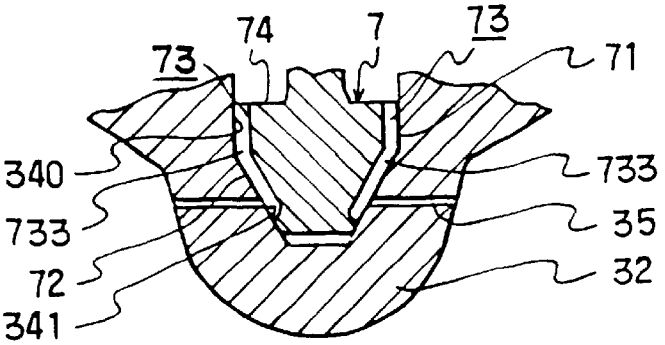

VARIABLE NOZZLE HOLE TYPE FUEL INJECTION NOZZLE

BACKGROUND OF THE INVENTION

This invention relates to a fuel injection nozzle, and particularly to a fuel injection nozzle whose nozzle hole area is variable.

As means for supplying fuel in an atomized state to an internal combustion engine such as a diesel engine, fuel injection nozzles are generally used. Such fuel injection A nozzles, as disclosed for example in Japanese Unexamined Patent Publication No. S.59-200063, have had a construction wherein a conical pressure-receiving surface is formed at the tip end of a needle valve axially slidably received inside a nozzle body and the needle valve is opened by a fuel pressure being made to act on this pressure-receiving surface and fuel is injected into a combustion chamber of the engine through a plurality of nozzle holes formed in the tip of the nozzle body.

However, with this construction, the fuel injection pressure, the injected amount and the injection speed are generally determined by a fuel injection pump, and also it is not possible to increase or decrease the total nozzle hole area. Consequently, during low-speed running of the engine the fuel injection pressure decreases and during low-load running the injection time becomes shorter and it is not possible to maintain a good combustion state, and it has been difficult to promote fuel combustion and achieve improvements in output and fuel consumption and reductions in combustion noise and NOx emissions.

As a measure to overcome this, in Japanese Unexamined Patent Publication No. H.6-241142 a fuel injection nozzle is proposed wherein a first set of nozzle holes (five) are provided on a circumference of a lower part of a wall of a needle valve having a closed tip and a second set of nozzle holes (five) of a different diameter from the first nozzle holes are provided on a different circumference and according to the load and speed of the engine either the first set of nozzle holes only are opened or both the first set of nozzle holes and the second set of nozzle holes are opened by the needle valve being moved axially in a sleeve.

In this related art, besides the problem that because the needle valve projects into the combustion chamber it undergoes thermal affects and distortion and the like are liable to occur, the injection angle with respect to the axis of the nozzle changes as a result of the sleeve fronting on the nozzle holes. Consequently, there has been a possibility of not being able to obtain optimum combustion with an existing combustion chamber shape designed with the injection angle assumed to be constant. Also, there has been the problem that to deal with this it becomes necessary to redesign the combustion chamber shape.

In Japanese Unexamined Patent Publication No. H.4-76266, a fuel injection nozzle is proposed wherein a well is formed in the tip part of a nozzle body, a plurality of nozzle holes (eight) connecting with the well are formed spaced in the circumferential direction in a wall enclosing the well, a rotating shaft is passed through a through hole formed axially down the center of the needle valve, a tip portion of this rotating shaft is positioned in the well, a plurality of grooves (four) which connect a fuel pressure chamber created inside the well when the needle valve opens to the nozzle holes are provided in the rotating shaft, and by rotation of this rotating shaft the number of open nozzle holes is switched between eight and four and the total area of the nozzle holes is thereby changed according to the load and speed of the engine.

This related art has the merit that because the rotating shaft turns about its axis to adjust the nozzle holes the injection angle with respect to the nozzle axis does not change substantially. However, with this related art, because the rotating shaft itself is used as a rotary valve, there have been problems in that when there is a machining error the whole shaft becomes a defective product and that it is liable to stop rotating smoothly due to bending or twisting.

Furthermore, the well wall forms a straight cylinder parallel with the nozzle axis, and the rotating shaft serving as the rotary valve is also cylindrical. Consequently, it has been difficult to fix the rotating shaft constituting the rotary valve during fuel injection, and even when the nozzle holes have been adjusted to a required degree of opening by the rotating shaft it has not been possible to avoid the rotating shaft slipping undesirably in its direction of rotation about its axis when a high fuel injection pressure acts at the nozzle holes and the relationship between the open holes and the grooves consequently slipping and the nozzle hole area becoming larger or smaller than the set size. For this reason, in the related art there has been the problem that it is not possible to accurately carry out control of the total nozzle hole area in accordance with the load and speed of the engine. Also, in the related art, because as described above there is no mechanism for fixing the rotary valve during fuel injection, there has been the problem that a large and relatively high-torque motor is needed to drive the rotating shaft and consequently the fuel injection nozzle becomes large.

SUMMARY OF THE INVENTION

It is therefore an object of the invention to provide a fuel injection nozzle with which when the needle valve is closed, i.e. at times other than during fuel injection, it is possible to control the angular position of the rotary valve (change the nozzle hole area) easily with a low torque and when the needle valve is open, i.e. during fuel injection, it is possible to firmly fix the position of the rotary valve with only the injection pressure of the fuel.

With this fuel injection nozzle, accurate adjustment of the total nozzle hole area in accordance with the load and speed of the engine can be realized with a low-torque actuator. Also, using an actuator having a small torque it is possible to change the nozzle hole area even during fuel injection, and as a result it also becomes possible to carry out injection rate control for pilot injections and the like.

A second object of the invention is, in addition to the first object, to provide a fuel injection nozzle which has a spray pattern characteristic such that the injection angle with respect to the axis does not change substantially and with which the number of sprays and the spray directions in the plane do not change substantially and it is possible to adjust the covered nozzle hole area steplessly and finely.

A third object of the invention is, in addition to the first and second objects, to provide a fuel injection nozzle with which also when the position of the rotary valve slips from injection to injection this is automatically corrected and dispersion in spray from injection to injection can be reduced.

To achieve the above-mentioned first object, the invention provides a fuel injection nozzle of a type having a well for guiding pressurized fuel formed in the tip of a nozzle body and a needle valve opened and closed by a predetermined fuel pressure disposed on the entrance side of the well, a plurality of nozzle holes for spraying pressurized fuel provided spaced in the circumferential direction in an enclosing wall bounding the well, and a rotary valve disposed inside the well, the open nozzle hole area being adjusted by the rotary valve being rotated by an actuator, wherein the enclosing wall bounding the well has a conical surface and the nozzle holes open at this conical surface and the rotary valve has at its upper end a pressure-receiving surface for receiving the pressure of the pressurized fuel and has at its periphery a conical surface of an angle matching the angle of inclination of the conical surface of the well and a plurality of fuel passages having one end opening at the pressure-receiving surface are provided spaced in the circumferential direction in the rotary valve and the fuel passages have their other ends opening at the conical surface of the rotary valve at the level of the nozzle holes.

Preferably, the conical surface of the well-enclosing wall and the conical surface of the rotary valve are given an angle such that a frictional holding torque overcoming a rotating torque tending to rotate the rotary valve in the circumferential direction resulting from injection pressure during fuel injection arises.

When this kind of construction is adopted, because a plurality of nozzle holes of the same diameter or of different diameters are disposed in a well-enclosing wall having a conical surface and fuel passages capable of connecting with the nozzle holes are provided in the rotary valve, if rotation of the rotary valve is controlled by means of an actuator, by way of the rotation angle of the rotary valve the covered area of the nozzle holes is changed or the fuel passages are selectively aligned with certain nozzle holes.

Furthermore, the rotary valve has at its upper end a pressure-receiving surface for receiving the pressure of the pressurized fuel and has at its periphery a conical surface of an angle matching the angle of inclination of the conical surface of the well-enclosing wall. As a result, when the needle valve opens and a fuel injection pressure acts, a frictional force overcoming a torque tending to rotate the rotary valve arises between the rotary valve and the well-enclosing wall. That is, by only the fuel injection pressure the rotary valve is fixed with a strong frictional force as a result of its dynamical relationship with the well-enclosing wall.

As a result, pressurized fuel is accurately sprayed through nozzle holes of a set opening area or through nozzle holes of a selected opening area. Because the rotary valve is fixed by the fuel injection pressure, not only of course at times other than during fuel injection but also when a required nozzle hole opening area has been set and fuel is being injected it is possible to rotate the rotary valve and vary the nozzle holes, and in this way it is possible to carry out control of pilot injection rates and the like easily. Also, because the rotary valve is surface-sealed tightly to the inner wall of the well, pressurized fuel does not flow circumferentially from the openings of the fuel passages.

To achieve the above-mentioned second object, in addition to the construction described above, the diameters of the nozzle holes in the enclosing wall bounding the well are made the same and the openings of the fuel passages at the conical surface of the rotary valve are made a size at least equal to the diameter of the nozzle holes and the degree of opening of the nozzle holes is changed gradually in correspondence with the amount of rotation of the rotary valve.

When this kind of construction is adopted, because only one diameter of nozzle hole is required, machining is easy. Also, because it is the degree of opening of nozzle holes of a single diameter that is adjusted, spraying is always carried out from all the nozzle holes and there is almost no change in the direction of the sprays in the plane. Also, because the sprayed amount can be changed finely, it is possible to conduct optimal spraying matched to the load and speed of the engine.

To achieve the above-mentioned third object, an angle detecting mechanism is provided on a driving shaft arrangement of the rotary valve and the output side of this angle detecting mechanism is connected to a controller for driving an actuator, and between fuel injections and/or during fuel injections the actuator is driven with a signal from the angle detecting mechanism and the angle of the rotary valve is corrected.

With this construction it is possible to fully exploit the merit of the position fixing characteristic of the rotary valve and effect optimal spraying matched to the load and speed of the engine.

Certain representative details and preferred embodiments of the invention are shown in the following, but it will be clear to a person skilled in the art that various changes and modifications are possible without deviating from the concept or scope of the invention.

BRIEF DESCRIPTION OF THE DRAWINGS

FIG. 3 is a partial enlarged view showing a needle valve having opened from its closed state of FIG. 1;

FIG. 3-A is a partial enlarged view of FIG. 3;

FIG. 4-A is a sectional view on the line X—X in FIG. 3 showing nozzle holes half open;

FIG. 4-B is a front view showing one nozzle hole in the state of FIG. 4-A;

FIG. 5-A is a sectional view on the line X—X in FIG. 3 showing nozzle holes fully open;

FIG. 5-B is a front view showing one nozzle hole in the state of FIG. 5-A;

FIG. 9 is a partial enlarged sectional view showing an example wherein another rotary valve is used in the first preferred embodiment;

FIG. 10 is a perspective view of the rotary valve in FIG. 9;

FIG. 11-A is a cross-sectional view of the first preferred embodiment applied to a nozzle hole selection type fuel injection nozzle, shown with large-diameter nozzle holes selected;

FIG. 11-B is a cross-sectional view of the same fuel injection nozzle shown with small-diameter nozzle holes selected;

FIG. 12 is a view illustrating parameters of when the rotary valve shown in FIG. 6 is used;

FIG. 12-A is a view illustrating forces acting on a fuel passage in FIG. 12;

FIG. 13 is a view illustrating a dynamical relationship around the rotary valve of when the nozzle holes are covered;

FIG. 18-A is a cross-sectional view on the line Y—Y in FIG. 17;

FIG. 18-B is a cross-sectional view showing a rotary valve being rotated from the state shown in FIG. 18-A to select nozzle holes;

FIG. 18-C is a cross-sectional view showing different nozzle holes from FIG. 18-A selected;

FIG. 19 is a perspective view showing an example of a rotary valve in the second preferred embodiment;

FIG. 20-A is a plan view showing another example of a rotary valve in the second preferred embodiment;

FIG. 20-B is a sectional view on the line Z—Z in FIG. 20-A;

FIG. 21 is a sectional view showing another example of a rotary valve in the second preferred embodiment.

DETAILED DESCRIPTION OF THE PREFERRED EMBODIMENTS

A preferred embodiment of the invention will now be described with reference to the accompanying drawings.

FIG. 1 through FIG. 10 show a first preferred embodiment of the invention.

Figure 1:
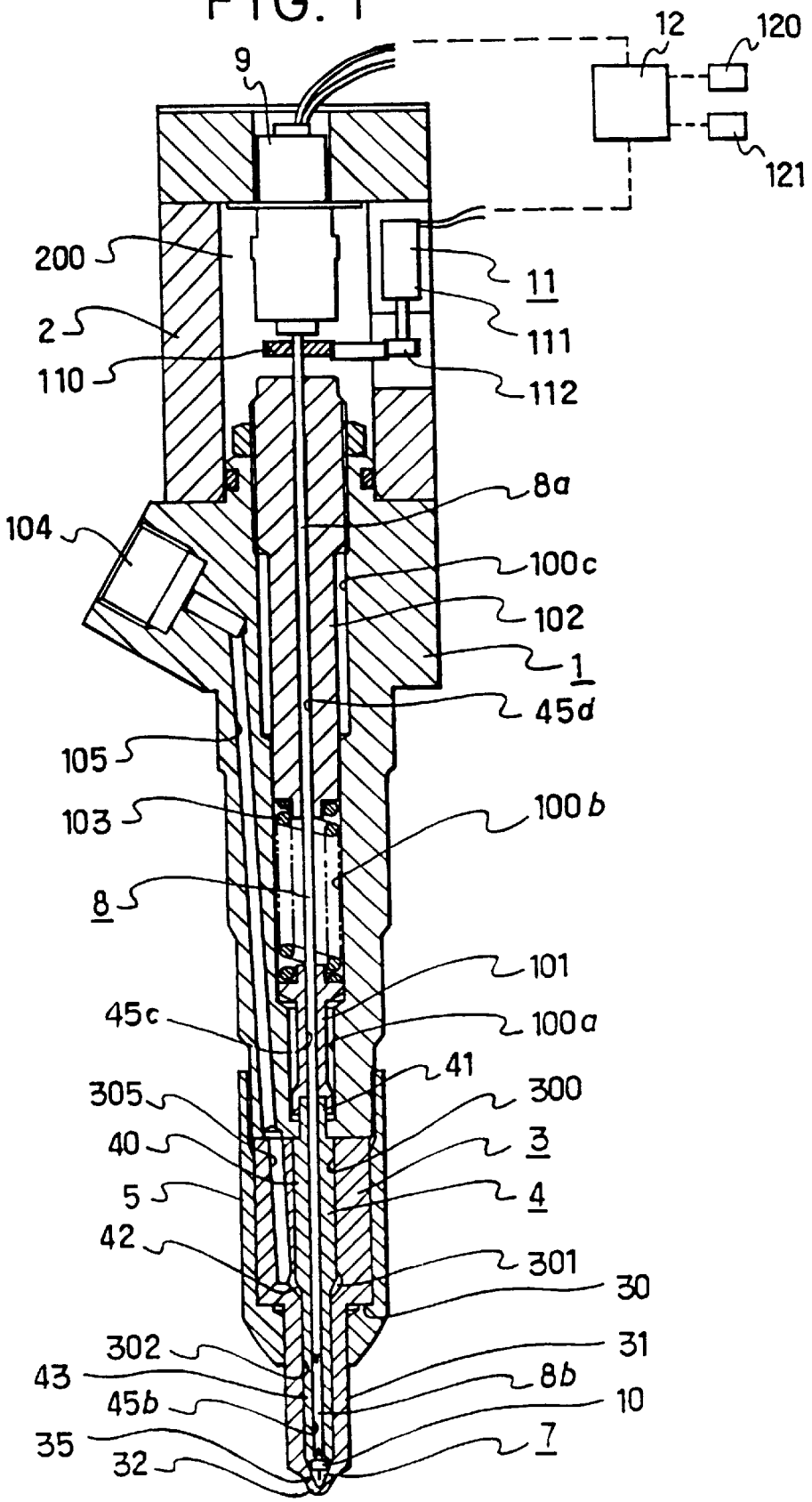
FIG. 1 is a longitudinal sectional side view showing a first preferred embodiment of the invention.

In FIG. 1, the reference numeral 1 denotes a nozzle holder proper; 2 a driving head oiltightly fitted to the upper end of the nozzle holder proper 1 with an O-ring therebetween; 3 a nozzle body extending from the lower end of the nozzle holder proper 1 and fastened to the nozzle holder proper 1 by a retaining nut 5; and 4 a needle valve (nozzle needle) passing through the nozzle body 3.

In the center of the nozzle holder proper 1 are formed a first hole 100*a*, a second hole 100*b* and a third hole 100*c* whose diameters successively increase from the lower end toward the upper end of the nozzle holder proper 1, and a push rod 101 is slidably disposed in a section extending from the first hole 100*a* into the second hole 100*b*.

An adjusting screw 102 screwed into a female thread formed in the third hole 100*c* is fitted in a section extending from the third hole 100*c* into the second hole 100*b*, and a nozzle spring 103 is interposed between this adjusting screw 102 and the push rod 101.

The nozzle body 3 has in the outside of its length-direction middle part a step 30 which fits in the bottom of the inside of the retaining nut 5 and has a main part 31 extending downward from this step 30 through the retaining nut 5, and the main part 31 has at its tip end a tapering part and below that a tip part 32 for having nozzle holes formed therein.

In the center of the nozzle body 3 are formed a guide hole 300 concentric with the first hole 100*a* in the nozzle holder proper 1 and below that a fuel reservoir 301 of a larger diameter than the guide hole 300, and below the fuel reservoir 301 is formed a feed hole 302 of a diameter smaller than that of the guide hole 300.

Figure 2:
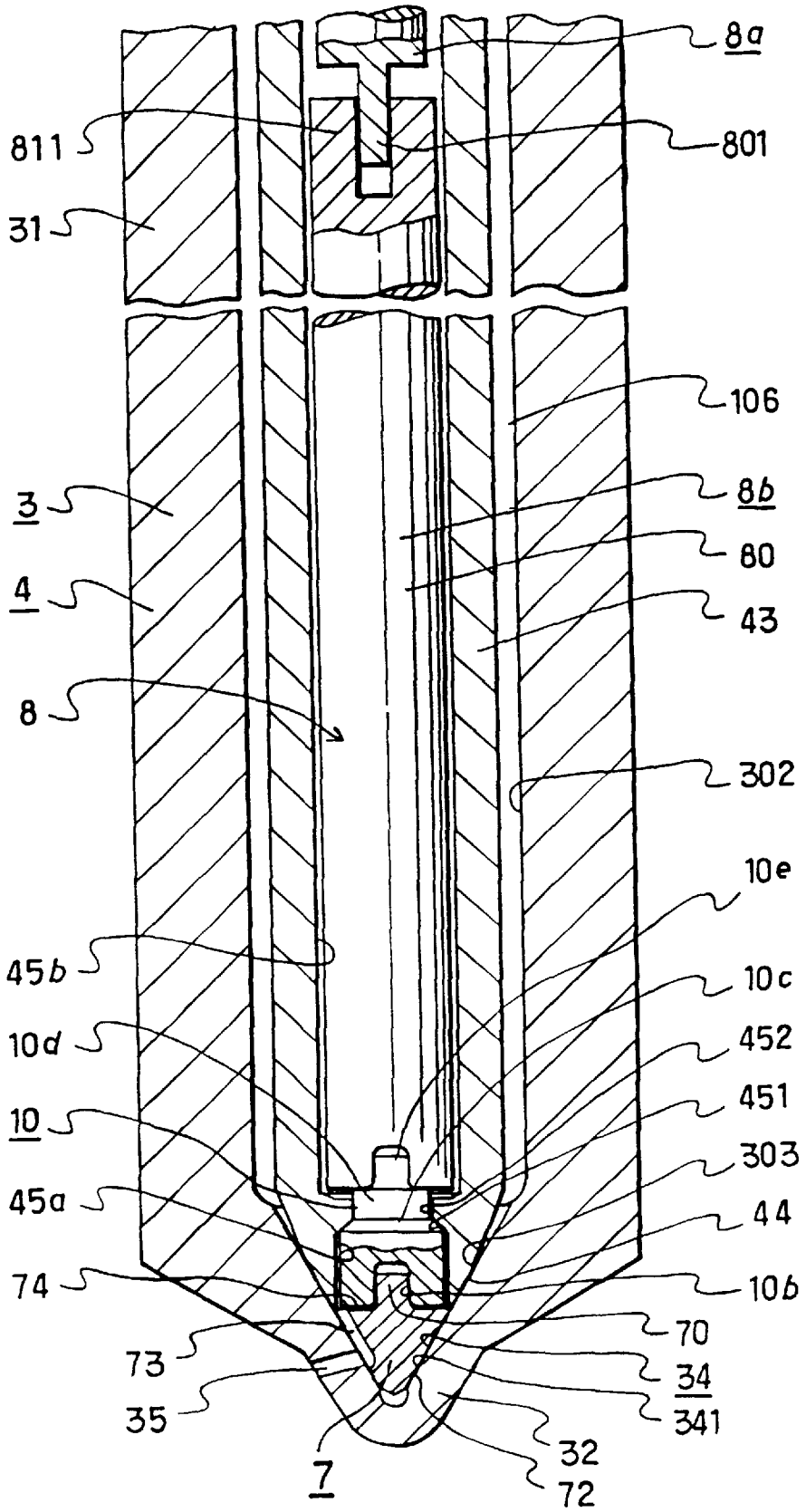
FIG. 2 is a partial enlarged view of FIG. 1.

As shown in FIG. 2, FIG. 3 and FIG. 3-A, a conical seat surface 303 is formed at the lower end of this feed hole 302 and a bottomed well 34 into which pressurized fuel is fed is formed immediately below this seat surface 303 by the enclosing wall of the tip part.

A pressurized fuel inlet 104 connected to an inlet connector is provided in one side of the nozzle holder proper 1, and this pressurized fuel inlet 104 is connected to the fuel reservoir 301 by passage holes 105, 305 formed in the nozzle holder proper 1 and the nozzle body 3 and guides pressurized fuel into the fuel reservoir 301.

The needle valve 4 has at its upper end a mating part 41 which mates with the push rod 101, and has at its periphery a guide part 40 which makes sliding contact with the guide hole 300. A pressure-receiving part 42 for receiving the fuel pressure inside the fuel reservoir 301 is provided at the end of the guide 40, and a thin shaft part 43 for forming a cylindrical fuel passage A between itself and the feed hole 302 is provided below this pressure-receiving part 42, as shown in FIG. 2. A conical seat surface 44 for coming in and out of contact with the above-mentioned seat surface 303 is formed on the lower end of this thin shaft part 43.

As shown in FIG. 2, FIG. 3 and FIG. 3-A, the inner side of the enclosing wall bounding the well 34 has a conical surface 341 smoothly continuous with the seat surface 303, and at the lower end of the conical surface 341 there is a hemispherical end wall surface.

As shown in FIG. 4-A and FIG. 4-B, a plurality of nozzle holes 35 connecting with the inside of the well 34 are provided with a uniform circumferential spacing in the conical surface 341 region of the enclosing wall 32 bounding the well 34. In this preferred embodiment there are five nozzle holes 35 extending radially with a circumferential spacing of 62°. The axis of each nozzle hole 35 may be perpendicular to the nozzle axis, but in this preferred embodiment has a predetermined angle of inclination to the nozzle axis. Also, although the shape of each nozzle hole 35 in a cross-section perpendicular to its axis in this preferred embodiment is circular, it may alternatively be polygonal. When a polygonal cross-sectional shape is used, it is possible to make the amount of change in the nozzle hole area per unit angle of turn of a rotary valve discussed below large.

A rotary valve 7 is disposed in the well 34. The rotary valve 7 is rotated about the nozzle axis by a drive shaft arrangement 8 passing through a through hole formed in the needle valve 4 and the adjusting screw 102 and driven by an actuator 9 mounted on the driving head 2.

Explaining this construction in more detail, in the middle of the needle valve 4, as shown in FIG. 2, a first hole 45*a* is formed over a relatively short range from the lower end of the needle valve 4, a conical surface 451 and a short hole 452 are formed at the upper end of this first hole 45*a*, and this short hole 452 connects with a second hole 45*b* of a larger diameter than the first hole 45*a*. The second hole 45*b* reaches the upper end of the needle valve 4. A third hole 45*c* of substantially the same diameter as the second hole 45*b* is formed in the center of the push rod 101, and a fourth hole 45*d* is formed in the center of the assisting screw 102 extending from the lower end to the upper end thereof. To prevent play of the drive shaft the diameter of an upper part of the fourth hole 45*d* is somewhat smaller than that of the rest.

In this preferred embodiment the drive shaft arrangement 8 is made up of a shaft proper 8*a* reaching the driving head 2, a connecting pin 8*b* and a coupling 10, and the rotary valve 7 is connected to the connecting pin 8*b* by way of the coupling 10.

The drive shaft proper 8*a* has a length such that it reaches from the fourth hole 45*d* to the lower part of the second hole 45*b*.

The connecting pin 8*b* has a large-diameter portion 80 which fits rotatably in the second hole 45*b*, and the upper end of the connecting pin 8*b* and the lower end of the drive shaft proper 8*a* are connected by means of joint parts 811, 801 of a type such as the Oldham coupling type allowing axial direction play so that turning force is transmitted between the two.

The coupling 10 is for transmitting turning torque and holding torque to the rotary valve 7 while allowing axial direction play of the rotary valve 7 caused by lifting of the needle valve 4, and an Oldham type coupling is used. More particularly, the coupling 10 has a cylindrical portion of a diameter such that it fits loosely in the first hole 45*a*, and a groove 10*b* for connecting to the rotary valve 7 slidably in the axial direction with respect thereto is formed in the lower end of this cylindrical portion. A conical surface 10*c* which sits on the conical surface 451 as shown in FIG. 2 and FIG. 3 is formed at the upper end of the cylindrical portion of the coupling 10, a short shaft portion 10*d* fitting into the short hole 452 extends from the upper end of this conical surface 10*c*, a projecting piece 10*e* is formed on the upper end of this short shaft portion 10*d* and this projecting piece 10*e* engages with a groove provided in the lower end of the large-diameter portion 80, whereby torque is transmitted.

The actuator 9 is fixed in a space 200 provided in the driving head 2. The actuator 9 can be any actuator having such characteristics that rotation (preferably reversible rotation) and holding of a predetermined angular position are possible, and for example a stepping motor or a servo motor is used. The output shaft of the actuator 9 and the upper end of the drive shaft proper 8*a* are connected directly or are connected by a transmission element such as an eccentric pin or gears.

Figure 6:
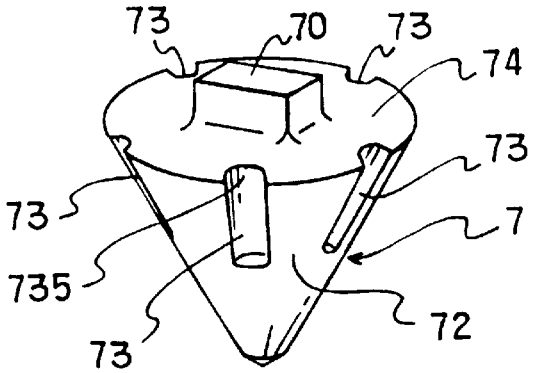
FIG. 6 is a perspective view of a rotary valve shown in FIG. 1 through FIG. 5.

An example (first example) of the rotary valve 7 is shown in FIG. 2 through FIG. 6. FIG. 6 shows the rotary valve 7 on its own. The rotary valve 7 has at its upper end a flat pressure-receiving surface 74 on which the pressure of pressurized fuel acts when the needle valve 4 is open. A projecting piece 70 is formed integrally in the middle of this pressure-receiving surface 74, and this projecting piece 70 is fitted vertically slidably in the groove 10*b* of the coupling 10.

The rotary valve 7 has a conical surface 72 tapering at an angle matching that of the conical surface 341 of the well 34, and a frictional seat surface is formed by the conical surface 72 and the conical surface 341. The conical surface 72 is limited to a height dimension such that its lower end does not make contact with the bottom wall of the well 34.

A plurality of fuel passages 73 having one end opening at the pressure-receiving surface 74 are formed in the rotary valve 7. These fuel passages 73 have their other ends opening so as to connect with the nozzle holes 35 formed in the conical surface 341 of the well 34. The cross-sections of the fuel passages 73 perpendicular to their axes must have a dimension at least equal to the diameter of the nozzle holes 35.

In this first example, the fuel passages 73 are five channels opening at the conical surface 72, and these channels are formed at a spacing in the circumferential direction of 62° so that they correspond with the nozzle holes 35 provided in the conical surface 341 of the well 34. The channel bottoms 735 of the channels are made substantially parallel with the inclination angle of the conical surface 72 of the rotary valve 7. The lower ends of the channels terminate at a level immediately below the nozzle holes 35.

Figure 7:
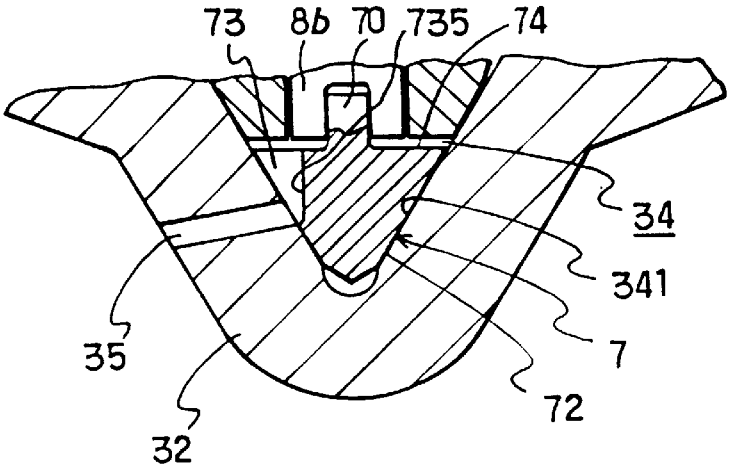
FIG. 7 is a partial enlarged sectional view showing an example wherein another rotary valve is used in the first preferred embodiment.
Figure 8:
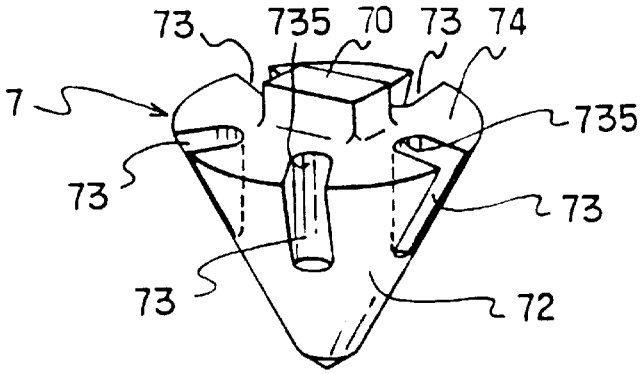
FIG. 8 is a perspective view of the rotary valve shown in FIG. 7.

FIG. 7 and FIG. 8 show another example (second example) of the rotary valve 7 used in the first preferred embodiment. In the rotary valve 7 of this example also the fuel passages 73 are channels, but as is clear from FIG. 7 their channel bottoms 735 are parallel with the axis of the nozzle. Otherwise the construction of this rotary valve 7 is the same as that shown in FIG. 2 through FIG. 6, and therefore corresponding parts have been given the same reference numerals and a description here will be omitted.

FIG. 9 and FIG. 10 show a further example (third example) of the rotary valve 7 used in the first preferred embodiment. In this example, the fuel passages 73 are not channels but rather are holes made by forming radially at a predetermined circumferential spacing (in this example, 62°) a plurality of (in this example, five) horizontal holes 730 capable of connecting with the nozzle holes 35 and forming a plurality of vertical holes 731 extending from the pressure-receiving surface 74 of the rotary valve 7 to the horizontal holes 730. The fuel passages 73 must have a diameter at least equal to that of the nozzle holes 35. Otherwise the construction of this rotary valve 7 is the same as that shown in FIG. 2 through FIG. 6, and therefore corresponding parts have been given the same reference numerals and a description here will be omitted.

FIG. 11-A and FIG. 11-B show examples wherein the first preferred embodiment of the invention is applied to make a type of nozzle in which nozzle holes of a plurality of different diameters are selected by rotation of the rotary valve 7.

In this example, the nozzle holes 35 provided extending in the radial direction from the conical surface 341 are made up of four first nozzle holes 35*a* formed spaced circumferentially at 90° and four second nozzle holes 35*b* formed with their phase staggered 45° on the circumference with respect to the first nozzle holes 35*a*, and the first nozzle holes 35*a* are of a smaller diameter than the second nozzle holes 35*b*. As an example the rotary valve 7 of the first example described above is used here, but a rotary valve of the structure of either of the second and third examples shown in FIG. 7 through FIG. 10 may alternatively be used.

In the first preferred embodiment, it is not always necessary for the whole of the well 34 to have a conical surface. That is, as in a second preferred embodiment which will be discussed below, a straight cylindrical surface parallel with the axis of the nozzle may be formed from the end of the seat surface 303 to the middle and the tapering conical surface 341 may be formed from the end of this straight cylindrical surface. In this case, the rotary valve 7 also has a straight cylindrical surface parallel with the nozzle axis from the pressure-receiving surface 74 to a middle part and the conical surface 72 is formed from the end of this. This is also included in the present invention.

In any of the first through third examples described above, the angle of inclination of the conical surface 341 of the well 34 and the conical surface 72 of the rotary valve 7 is normally selected from the range of 50° to 70°. In the examples shown in the figures this angle is 60°.

In FIG. 2 through FIG. 10 there are five nozzle holes 35 and five fuel passages 73, but of course the invention is not limited to this and there may be four or six or more of each. Also, although in FIG. 11-A and FIG. 11-B there are eight nozzle holes 35 altogether and there are four fuel passages 73, there may alternatively be more or fewer than this. For example, there may be three first nozzle holes 35*a*, three second nozzle holes 35*b*, and three fuel passages 73 in the rotary valve 7. Also, the nozzle holes 35 may have three different hole diameters, large, medium and small.

The timing at which the rotary valve 7 is turned by the actuator 9 is preferably made a time when no axial direction force is acting on the drive shaft arrangement 8 due to the internal pressure of the engine cylinder, i.e. during the intake stroke or the exhaust stroke of the engine.

To carry out this rotation timing control, a controller 12 consisting of a CPU is electrically connected to the actuator 9, and an engine or fuel injection pump speed-detecting sensor 120 (or angle-detecting sensor) and a load-detecting sensor 121 using a fuel injection pump rack sensor or the like are connected to inputs of the controller 12. By this means, a signal from the speed-detecting sensor 120 is constantly inputted into the controller 12, and when it is determined that the engine is in one of the above-mentioned strokes a driving signal is outputted to the actuator 9. A signal from the load-detecting sensor 121 is simultaneously inputted into the controller 12, and according to a predetermined map of load and speed data, driving control such that a predetermined driving amount (driving rotation angle) is outputted to the actuator 9 so that for example the angle gradually increases in the order of low-speed, low-load running→medium speed, medium load running→high speed, high load running is carried out.

Also, in this invention, preferably an angle detecting mechanism 11 is mounted on the rotary shaft arrangement. The angle detecting mechanism 11 is means for carrying out correction by detecting the actual angle of the rotary valve 7 every fuel injection and feeding this actual angle signal into the controller 12 as a feedback signal and causing a driving signal to be outputted from the controller 12 to the actuator 9 when there is an error between this and the set angle.

The angle detecting mechanism 11 may for example be a potentiometer, an encoder or a collimator. In this preferred embodiment a potentiometer is used: as shown in FIG. 1, a rotating member 110 is fixed to the shaft proper 8*a*, and this rotating member 110 is connected directly or by a transmission element such as a belt to a rotating member 112 fixed to the shaft of a potentiometer proper 111. When a collimator is used, a reflector of a regular polygonal shape corresponding to the number of nozzle holes (in this example pentagonal) is fixed to the drive shaft proper 8*a*, a light source shining a beam of light onto the reflector is mounted in the wall of the driving head 2, and a light-detecting part consisting of a row of opto-electric convertor elements, i.e. light-detecting elements, is mounted in the inner wall of the driving head 2 extending from the vicinity of the light source. The light-detecting part is provided extending over at least the angular range of 360° divided by the number of nozzle holes (in this example, 72°), and its output side is connected to the controller 12. The drive shaft arrangement on which the angle detecting mechanism 11 is mounted is not necessarily limited to the shaft proper 8*a*. Alternatively, an output shaft coaxial with the drive shaft proper 8*a* may be provided on the opposite side of the actuator 9 from the shaft proper and the rotating element of the angle detecting mechanism 11 may be mounted on this.

Figure 22:
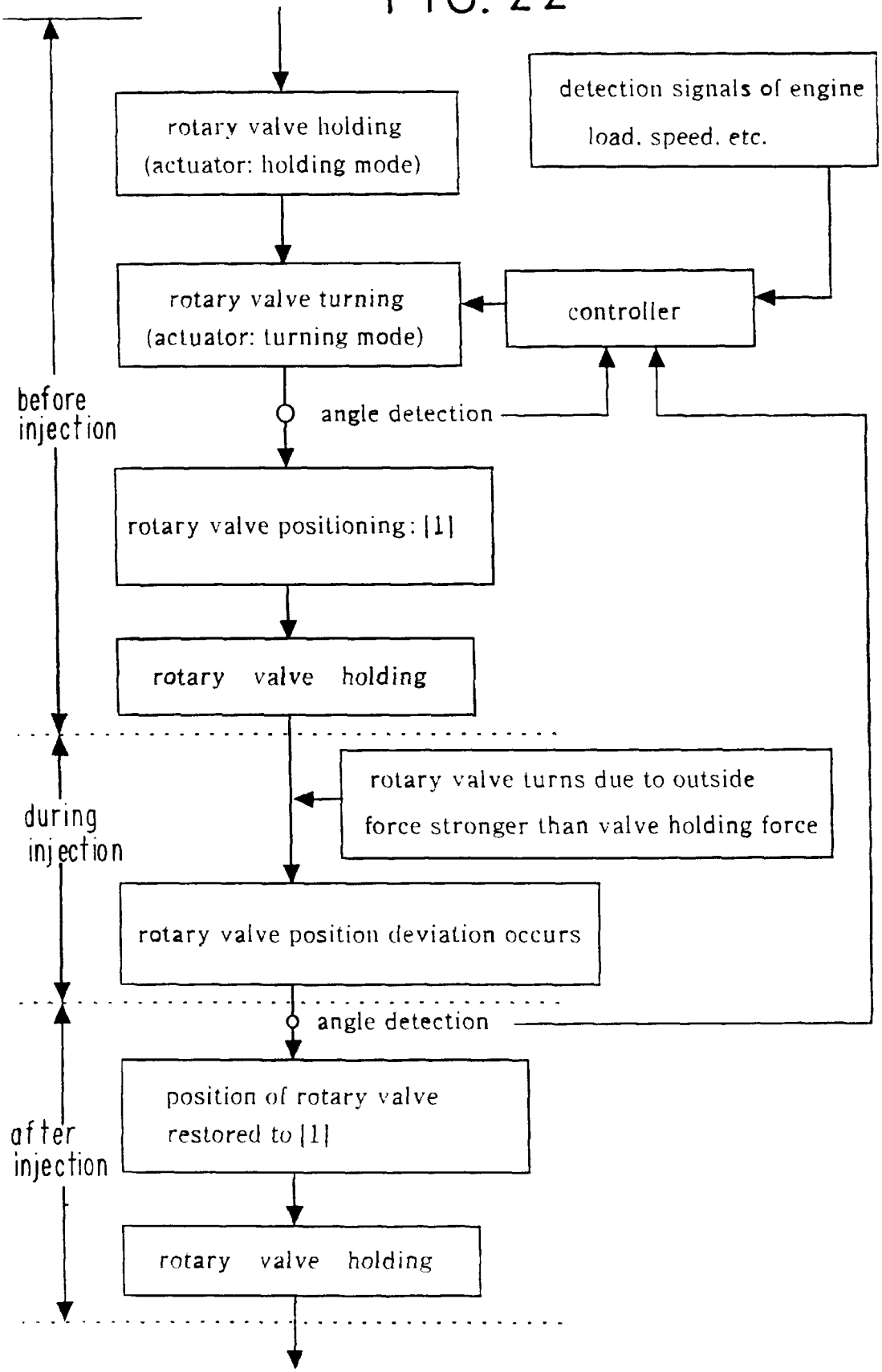
FIG. 22 is a flow chart of nozzle hole control in the invention.

Before and after injection the rotary valve 7 is given a series of movements by the actuator 9 according to a flow chart of the kind shown in FIG. 22. However, in this preferred embodiment, because the conical surface 72 and the conical surface 341 of the well 34 have their relative position held by frictional force resulting from the pressure of the pressurized fuel acting on the pressure-receiving surface 74 of the rotary valve 7, the rotary valve 7 can be turned even during fuel injection.

FIG. 12 through FIG. 15 show torque acting on the rotary valve 7 in the first preferred embodiment.

FIG. 12 and FIG. 12-A show a dynamical relationship in a case where the first example shown in FIG. 2 through FIG. 6 (this will be called the first type) is used as the rotary valve 7.

If the fuel injection pressure is written P, the holding torque provided by frictional force arising between the conical surface 72 of the rotary valve 7 and the conical surface 341 of the well 34 as a result of this fuel injection pressure P can be found as follows.

That is, writing the coefficient of friction as $\mu$, the radius of the pressure-receiving surface as $r_1$, the radius of the lower end of the conical surface 72 as $r_2$ and the angle of inclination of the conical surfaces 72 and 341 of the rotary valve and the well with respect to the nozzle axis as $\alpha$, since $\mu$ is a parameter determined by materials, $\mu'=\mu/(\sin\alpha+\mu\cos\alpha)$.

Because the force acting on the rotary valve is related to the area of the pressure-receiving surface 74, the force F acting as a result of the injection pressure is $F=\pi r_1^2P$.

However, in this example the fuel passages 73 of the rotary valve 7 are channels, and because their channel bottoms 735 are parallel with the inclination angle of the conical surface 72 a reaction R shown in FIG. 12-A arises. Therefore, if the area of the channel bottoms 735 is written A, the force F acting as a result of the injection pressure is:

$$F=(\pi r_1^2P)-(A\times P\times\sin\alpha).$$

Accordingly, if the effective friction radius is written rd, the holding torque $T_2$ (Nm) acting on the rotary valve 7 is given by Exp. (1):

$$T_2=\mu'\cdot\{(\pi r_1^2P)-(A\times P\times\sin\alpha)\}\cdot rd \qquad \text{Exp.(1)}$$

Next, the maximum torque tending to rotate the rotary valve arising as a result of the fuel injection pressure when the nozzle holes 35 are partly covered will be discussed. From equilibrium of the forces in the section B–B' shown in FIG. 13 and the equations of motion pertaining to the section B–B' vicinity, if the external force acting on the rotary valve 7, i.e. the force tending to turn the rotary valve 7 in the direction $\theta$, is written as F, the velocity of the fuel at the section B–B' as V, the radial direction component of the velocity V as Vr, the $\theta$ direction component of the velocity V as $V\theta$, the flow velocity change across the section B–B' as $\Delta v$, the flow as Q, the density as $\rho$, the flow coefficient as C (normally 0.6 to 1.0), the number of nozzle holes as n and the nozzle hole diameter as d, the maximum value $F\theta$) of the force acting on the rotary valve 7 is:

$$F\theta=\pi/2\cdot d^2\cdot C^2\cdot\Delta P.$$

Therefore, the rotating torque $T_1$ (Nm) is given by Exp. (2):

$$T_1=(\pi/2\cdot d^2\cdot C^2\cdot\Delta P)rd\times n \qquad \text{Exp. (2)}$$

Therefore, the rotary valve 7 can be fixed in position with just the fuel injection pressure by so selecting $r_1$, $r_2$ and $\alpha$ and so on of the rotary valve 7 that $T_1<T_2$ is satisfied. Also, by setting the angle of inclination of the channel bottoms 735 to be other than parallel with the conical surface 72 it is possible to change the force F acting on the rotary valve 7 due to the injection pressure and by this means it is possible to change the rotating torque also.

Figure 14:
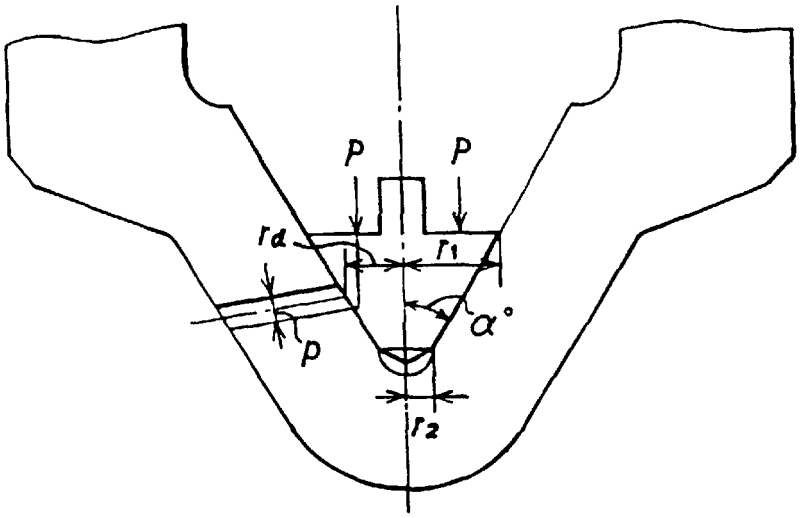
FIG. 14 is a view illustrating parameters of when the rotary valve shown in FIG. 7 is used.

FIG. 14 shows forces acting on the rotary valve when the second example shown in FIG. 7 and FIG. 8 (this will be called the second type) is used as the rotary valve 7. In this case, because the channel bottoms 735 of the fuel passages 73 are parallel with the nozzle axis, the holding torque $T_2$ (Nm) on the rotary valve is given by Exp. (1'):

$$T_2=\mu'\cdot\pi\{(r_1^3+r_1^2\cdot r_2)/2\}P \quad \text{Exp. (1')}$$

The rotating torque $T_1$ (Nm) acting on the rotary valve due to the fuel injection pressure in this case is given by Exp. (2'):

$$T_1=(\pi/2\cdot d^2\cdot C^2\cdot\Delta P\cdot rd)\times n \quad \text{Exp. (2')}$$

Therefore, in this case also, if $r_1$, $r_2$ and a and so on of the rotary valve 7 are selected so that $T_1<T_2$ is satisfied, the rotary valve 7 can be fixed in position with just the fuel injection pressure.

Figure 15:
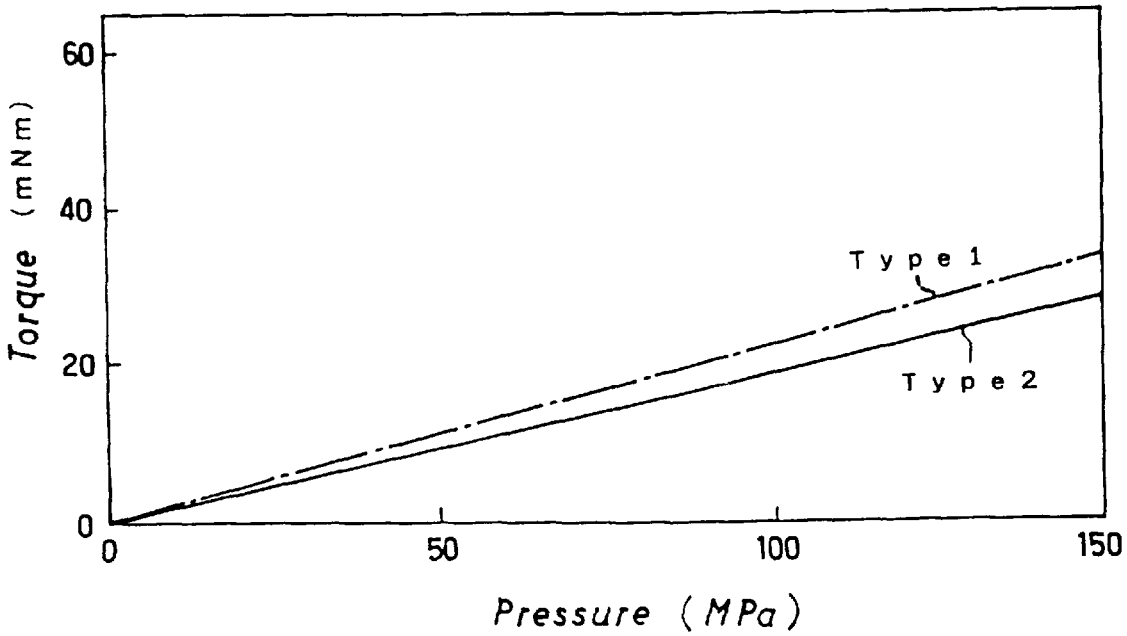
FIG. 15 is a torque graph for the rotary valves shown in FIG. 6 and FIG. 7.

FIG. 15 is a torque graph of the first type and the second type, and shows that the holding torque provided by frictional force between the rotary valve and the well wall is greater than the maximum torque arising due to fuel flow at all fuel injection pressures and the rotary valve can be fixed in a required angular position surely. When the fuel passages 73 are hole types of the kind shown in the third example of FIG. 9 and FIG. 10, the holding torque on the rotary valve 7 is substantially the same as in the case of the second type.

FIG. 16 through FIG. 21 show a second preferred embodiment of the invention. In this second preferred embodiment the nozzle holes 35 of the well 34 have a plurality of different diameters and the total nozzle hole area is adjusted by these different nozzle holes 35 being covered by the rotary valve 7.

Figure 16:
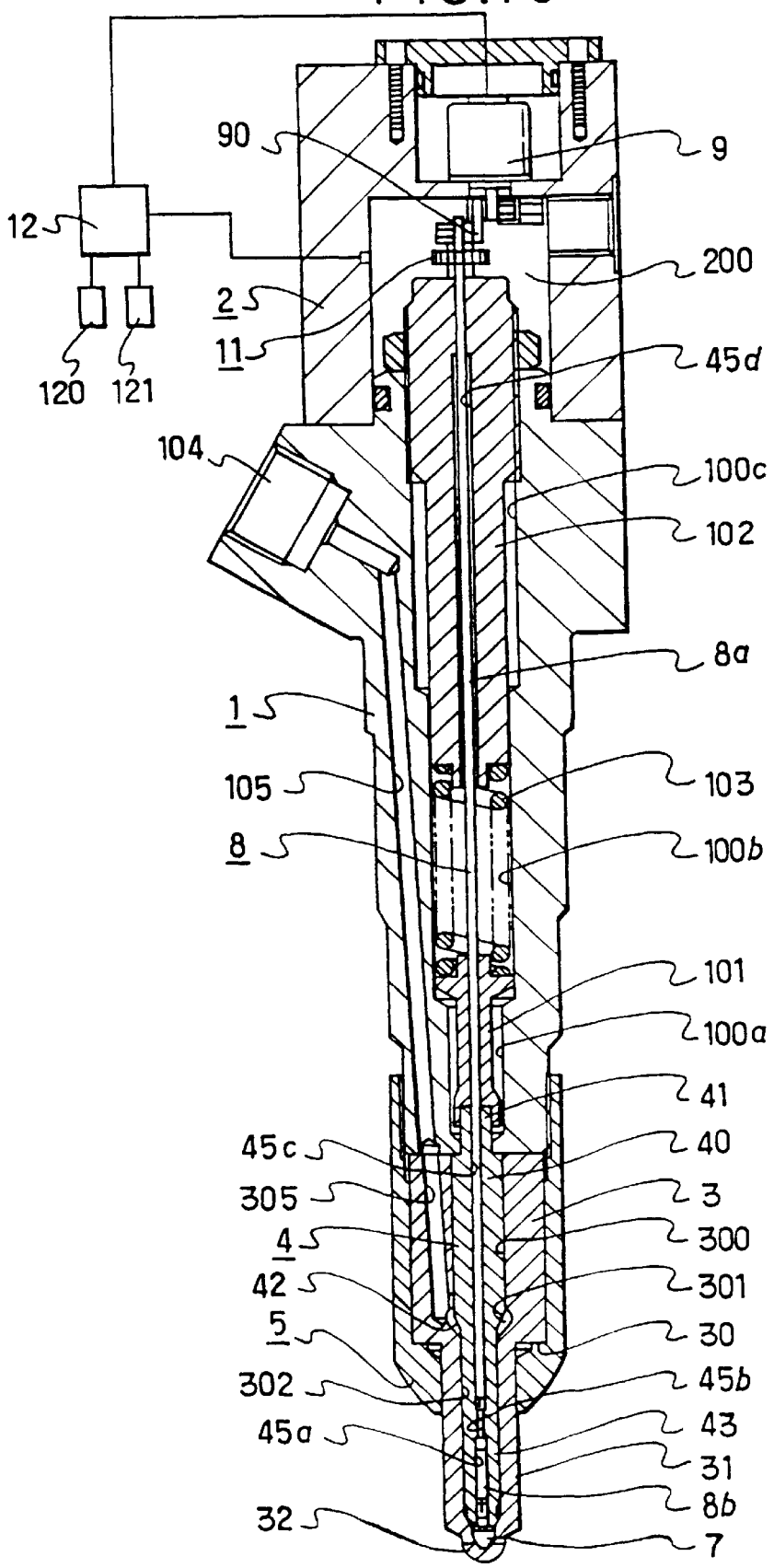
FIG. 16 is a cross-sectional side view showing a second preferred embodiment of the invention.
Figure 17:
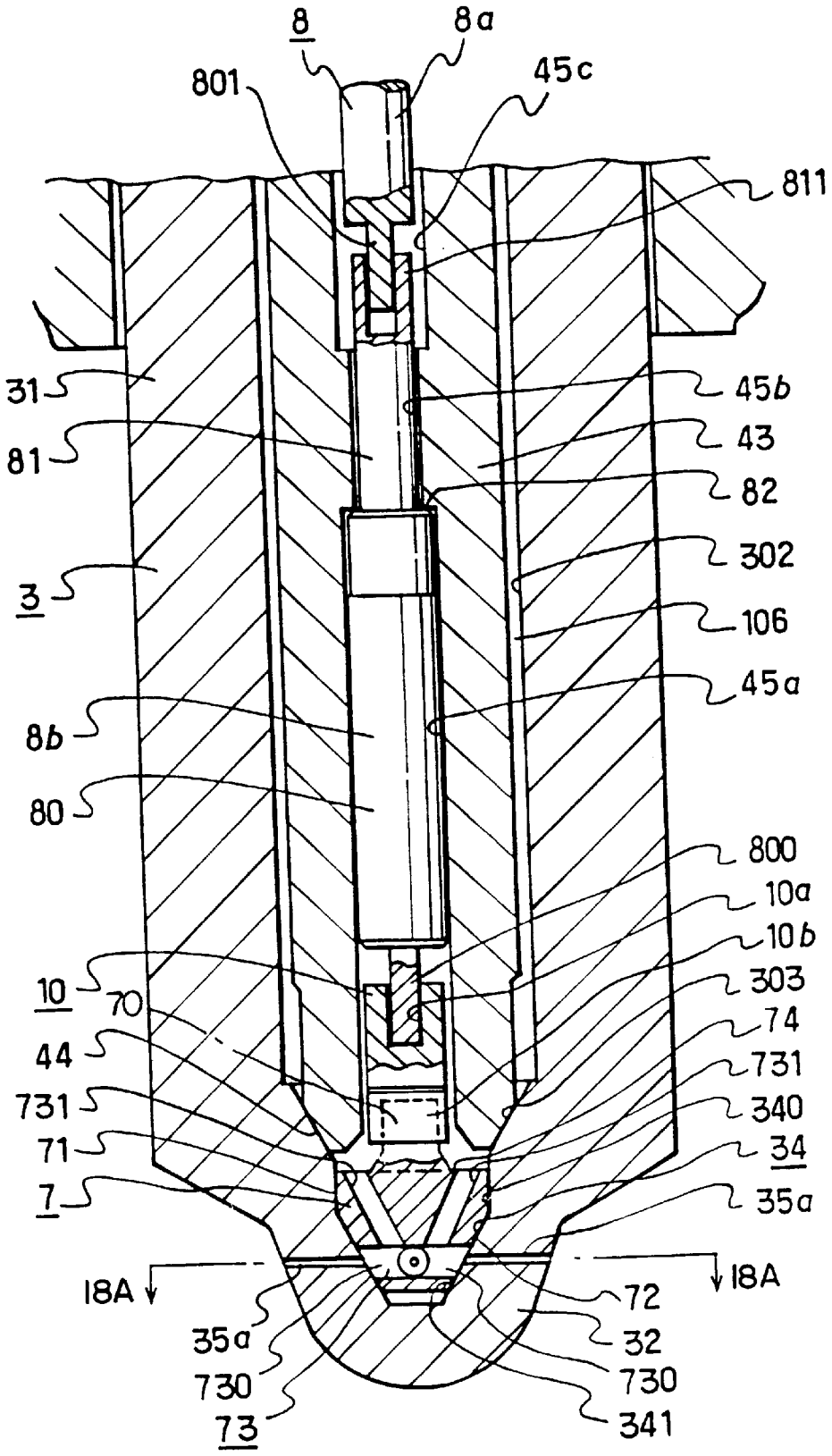
FIG. 17 is a partial enlarged view of FIG. 16.

FIG. 16 shows the whole of the fuel injection nozzle, and FIG. 17 shows a main part thereof enlarged. In this second preferred embodiment, a bottomed well 34 has a straight cylindrical surface 340 extending parallel with the nozzle axis from the end of a seat surface 303 to a predetermined position, a conical surface 341 is formed from the end of this straight cylindrical surface 340, and at the lower end of the conical surface 341 there is a flat or curved end wall.

As shown in FIG. 17 and FIG. 18, a plurality of nozzle holes 35 connecting with the well 34 are provided with a predetermined spacing in the circumferential direction in the conical surface 341 region of the enclosing wall bounding the well 34. In this preferred embodiment, the nozzle holes 35 are made up of four first nozzle holes 35*a* formed circumferentially spaced at 90° and four second nozzle holes 35*b* formed with their phase shifted 45° on the circumference with respect to the first nozzle holes 35*a*, and the first nozzle holes 35*a* are of a smaller diameter than the second nozzle holes 35*b*.

The rotary valve 7 has at its upper end a flat pressure-receiving surface 74 which receives the pressure of pressurized fuel and the periphery continuing from this pressure-receiving surface 74 has a straight cylindrical surface 71 of a diameter matching that of the straight cylindrical surface 340 of the well 34 and from the lower end of the straight cylindrical surface 71 a conical surface 72 serving as a surface contact portion tapering at an angle matching that of the conical surface 341, and the lower end of the conical surface 72 forms a flat or arcuate surface so that it does not make contact with the bottom wall of the well 34.

This rotary valve 7 is provided with fuel passages 73 each having one end opening at the conical surface 72 and the other end opening at the pressure-receiving surface 74.

In this preferred embodiment the fuel passages 73 are holes made by forming radially with a predetermined circumferential spacing (in this example, 90°) a plurality of (in this example, four) horizontal holes 730 capable of connecting with the nozzle holes 35*a* and 35*b* in the enclosing wall bounding the well and forming a plurality of vertical holes 731 connecting with the horizontal holes 730 from the pressure-receiving surface 74.

The fuel passages 73 must have a diameter at least equal to the diameter of the largest of the nozzle holes 35. However, the cross-sections of the fuel passages 73 perpendicular to their axes do not have to be circular and may alternatively be for example polygonal like the nozzle holes mentioned earlier.

FIGS. 20-A and 20-B show another version of the rotary valve 7 of the second preferred embodiment.

In this version also, the fuel passages 73 are holes and have one end opening at the conical surface 72, but in this version the fuel passages 73 are a plurality of (in this example, four) diagonal holes 732 intersecting with the axis of the rotary valve 7 and the diagonal holes 732 open with a predetermined circumferential spacing (in this example, 90°) and the other ends (the upper ends) of the diagonal holes 732 open at the pressure-receiving surface 74. In the case of this version, the nozzle holes 35 also have their axes inclined like the diagonal holes 732, and the fuel passages 73 must have a diameter at least equal to the diameter of the largest of the nozzle holes 35.

FIG. 21 shows another version of the rotary valve 7 of the second preferred embodiment.

This version corresponds to FIG. 6 and FIG. 8 of the first preferred embodiment, and in it the fuel passages 73 are a plurality of (in this example, four) channels 733.

The channels 733 are formed with a predetermined circumferential spacing (in this example, 90°) extending from the straight cylindrical surface 71 through the conical surface 72 so that their lower ends reach a level slightly below the nozzle holes 35. The width of the channels 733 must be a dimension at least equal to the diameter of the largest of the nozzle holes 35.

In the second preferred embodiment the nozzle holes 35 consist of four first nozzle holes 35*a* and four second nozzle holes 35*b* and there are four fuel passages 73 in the rotary valve 7, but alternatively there may be more or fewer than this. For example there may be three of each of the first nozzle holes 35*a* and the second nozzle holes 35*b* and three of the fuel passages 73 in the rotary valve 7. Also, instead of two there may be three diameters of nozzle holes 35, large, medium and small.

In this second preferred embodiment, the well 34 and the rotary valve 7 may be made the same shape as those shown in the first preferred embodiment. That is, instead of the straight cylindrical surface 340 being provided in the well 34 the conical surface 341 may be formed immediately below the seat surface 303, and instead of the straight cylindrical surface 71 being provided on the rotary valve 7 the conical surface 72 may be immediately below the pressure-receiving surface 74.

The angle of inclination of the conical surfaces 341, 72 of the well 34 and the rotary valve 7 of this second preferred embodiment is also preferably generally selected from the range of 50 to 70°. The relationship between the holding torque and the rotating torque on the rotary valve is clearly the same as in the case of the first preferred embodiment and therefore will not be discussed here.

As in the first preferred embodiment, the rotary valve 7 is rotated to predetermined angles by a drive shaft arrangement 8 passing through a through hole formed in the needle valve 4 and the adjusting screw 102 and an actuator 9 mounted on the driving head 2.

In the second preferred embodiment also, this drive shaft arrangement 8 is made up of a shaft proper 8*a*, a connecting pin 8*b* and a coupling 10. Although its detailed construction may be the same as in the first preferred embodiment, in this preferred embodiment it has been given a slightly different construction.

That is, as shown in FIG. 17, a first hole 45*a* is formed extending in the axial direction from the lower end of the needle valve to an intermediate position, a second hole 45*b* thinner than this is formed from the end of this first hole 45*a*, a third hole 45*c* of the same diameter as the first hole 45*a* is formed from the end of the second hole 45*b* to the upper end of the push rod 101 and a fourth hole 45*d* is formed in the assisting screw 102 extending from the lower end to the upper end thereof. To prevent play of the drive shaft the diameter of an upper part of the fourth hole 45*d* is somewhat smaller than that of the rest.

The shaft proper 8*a* has a length such that it reaches from the fourth hole 45*d* to the lower end of the third hole 45*c*, and its diameter is somewhat smaller than that of the third hole 45*c*.

So that the connecting pin 8*b* functions as a sealing part it has a large-diameter portion (surface sealing portion) 80 which rotatably fits precisely in the end of the first hole 45*a*, and a small-diameter portion 81 which fits in the second hole 45*b* is provided extending upward from the end of the large-diameter portion 80. Consequently a stopping step 82 is formed at the boundary between the small-diameter portion 81 and the large-diameter portion 80, and by this abutting with the upper end face of the first hole 45*a* the connecting pin 8*b* is moved up and down integrally with the needle valve 4.

The upper end of the small-diameter portion 81 and the lower end of the drive shaft proper 8*a* are connected by means of joint parts 811, 801 of a type such as the Oldham coupling type allowing axial direction play so that turning force is transmitted between the two.

A coupling 10 is connected to the large-diameter portion 80 of the connecting pin 8*b* so as to allow relative sliding in the axial direction of the rotary valve 7. In this preferred embodiment an Oldham coupling is used as the coupling 10. This coupling 10 has an external diameter smaller than the diameter of the first hole 45*a*. A projecting piece 800 extending from the lower end of the large-diameter portion of the connecting pin 8*b* fits in a groove 10*a* formed in the upper half of the coupling 10, and a projecting piece 70 formed in the pressure-receiving surface 74 of the rotary valve 7 fits in a groove 10*b* formed in the lower half of the coupling 10 at 90° to the groove 10*a*.

The relationships between the projecting pieces and grooves may of course be the reverse of this. Also, the upper and lower halves of the coupling may both have a projecting piece or may both have a groove, and in this case grooves or projecting pieces to mate with these are provided on the connecting pin 8*b* and the rotary valve 7 accordingly.

A stepping motor or a servo motor is used as the actuator 9, and its output shaft and the upper end of the shaft proper 8*a* are either directly connected or connected by a transmission element (for example gears or an eccentric pin) 90. The timing at which the rotary valve 7 is turned by the actuator 9 generally is preferably made a time when no axial direction force is acting on the drive shaft arrangement 8 due to the internal pressure of the engine cylinder, i.e. during the intake stroke or the exhaust stroke of the engine, as in the first preferred embodiment.

This rotation timing control is the same as in the first preferred embodiment. That is, as shown in FIG. 16 the actuator 9 is electrically connected to a controller 12 consisting of a CPU or the like and a signal from an engine or fuel injection pump speed-detecting sensor (or angle-detecting sensor) 120 is inputted into the controller 12, and when it is determined that the engine is in one of the above-mentioned strokes a driving signal is outputted to the actuator 9. A signal from a load-detecting sensor 121 using a fuel injection pump rack sensor or the like is simultaneously inputted into the controller. A predetermined map of load and speed data is inputted into the controller 12 and according to this map a predetermined driving amount (driving rotation angle) is outputted to the actuator 9.

For example, a driving amount which switches the rotary valve 7 between positions so that during low-speed, low-load running the first nozzle holes 35*a* are aligned with the fuel passages 73 and during high speed, high load running the second nozzle holes 35*b* are aligned with the fuel passages 73 is fed to the actuator. This point is different from the first preferred embodiment, which is a type wherein the covered area of nozzle holes 35 having the same diameter is changed.

In this second preferred embodiment also, as shown in FIG. 16, an angle detecting mechanism 11 may be provided on for example the shaft proper 8*a* of the drive shaft arrangement 8. This angle detecting mechanism 11 may be any suitable detecting mechanism such as an encoder, a collimator or a potentiometer.

The rest of the construction of the second preferred embodiment is the same as that of the first preferred embodiment, and therefore the same parts have been given the same reference numerals as their equivalents in the first preferred embodiment and will not be described here.

The drive shaft arrangement 8 is not limited to the forms described in the first preferred embodiment and the second preferred embodiment. That is, the connecting pin 8*b* may be dispensed with and the drive shaft arrangement 8 may be made up of a shaft proper 8*a* and a coupling 10 only. In this case, the upper end of the coupling 10 is fitted to the lower end of the shaft proper 8*a* slidably relative thereto in the axial direction.

The operation of the preferred embodiments of the invention will now be described.

In the first preferred embodiment, pressurized fuel is fed from a fuel injection pump (not shown) through a pipe to the pressurized fuel inlet 104 and is pushed through the passage holes 105, 305 into the fuel reservoir 301 and from there passes down through an annular fuel passage 106.

This pressurized fuel simultaneously acts on the pressure-receiving surface 42 of the needle valve 4 located in the fuel reservoir 301, and when the fuel pressure reaches a pressure such that it overcomes the set force of the nozzle spring 103 the needle valve 4 is lifted and the seat surface 44 at the lower end of the needle valve moves away from the seat surface 303 of the nozzle body 3 and the needle valve 4 opens. The state at this time is that shown in FIG. 3, and pressurized fuel enters the well 34 and flows into the fuel passages 73 of the rotary valve 7. If the fuel pressure falls, the needle valve 4 is pushed down and closed by the urging force of the nozzle spring 103.

On starting of the engine the needle valve 4 is closed and the fuel passages 73 of the rotary valve 7 are not aligned with the nozzle holes 35 passing through the enclosing wall of the well 34, and the nozzle holes 35 are covered by areas of conical surface between the fuel passages 73. At this starting time no driving signal has been sent from the controller 12 to the actuator 9, and the actuator 9 is in a holding mode.

When during an intake stroke or an exhaust stroke of the engine cylinder information signals of the engine or fuel injection pump speed (or turn angle) and load are sent to the controller 12 from the speed-detecting sensor 120 and the load-detecting sensor 121, an angle of the rotary valve corresponding to these is calculated. A driving amount signal corresponding to this is fed to the actuator 9, a driving force of the actuator 9 is transmitted to the drive shaft proper 8*a*, this rotating torque is transmitted through the connecting pin 8*b* and the coupling 10 to the rotary valve 7 and the rotary valve 7 rotates through a required rotation angle for example in the clockwise direction.

During this rotation, because no axial direction load is acting on the rotary valve 7, the conical surface 72 is not strongly making contact with the conical surface 341 of the well 34 and therefore the rotary valve 7 can be easily and smoothly turned to the desired angle.

The actual angular position of the drive shaft proper 8*a* at this time is detected by the angle detecting mechanism 11. This angle detection signal is fed back to the controller 12, whether or not there is an error between this and the set angle is determined in the controller 12, and when there is an error a driving signal is sent from the controller 12 to the actuator 9 and the drive shaft proper 8*a* is finely driven and positional correction of the rotary valve 7 is carried out. When the position has been brought to the set angle in this way, a holding signal is outputted from the controller 12 to the actuator 9 and the rotary valve 7 is held in that position.

FIG. 4-A and FIG. 4-B show a state wherein the rotary valve 7 has been rotated and the edges of the fuel passages 73 have come to positions half-way across the diameters of the nozzle holes 35, i.e. a state wherein the degree of opening of the nozzle holes has been brought to ½. In this state, the conical surface 72 of the rotary valve 7 is positioned so that it halves the nozzle holes 35. FIG. 5-A and FIG. 5-B show a state wherein the rotary valve 7 has rotated further and the fuel passages 73 have been aligned with the nozzle holes 35 and the nozzle holes 35 are fully open.

If from this state the fuel pressure increases and the needle valve 4 opens, high-pressure fuel passes through the openings in the pressure-receiving surface 74 of the rotary valve 7 and through the fuel passages 73 and flows into the nozzle holes 35 at the set degree of opening and is sprayed into the engine cylinder.

At this time of injection the fuel injection pressure acts on the pressure-receiving surface 74 of the upper end of the rotary valve 7. As a result the rotary valve 7 is pushed down in the axial direction and the conical surface 72 of its periphery makes surface contact strongly with the conical surface 341 of the well 34 and forms a surface seal, and here a fixing force provided by frictional force arises. As is clear from Exps. (1) and (2) above, this frictional fixing force is greater than the force due to fuel pressure acting on the nozzle holes 35 tending to move the rotary valve 7 about its axis.

As a result, the rotary valve 7 having been turned through a predetermined angle to change the degree of opening of the nozzle holes while the needle valve 4 is closed has its position firmly fixed when the needle valve 4 is open, i.e. during fuel injection periods.

Therefore, because the nozzle holes 35 in the well 34 are covered in accordance with the turn angle given to the rotary valve 7, the nozzle hole area can be freely changed steplessly. For example, during low-load running the fuel injection pressure is made higher along with a reduction in the nozzle hole area and the injection period becomes long. As a result, promotion of fine atomization of the spray and increase in the excess air ratio of the spray can be expected and NOx emissions are reduced. Also, during high-load running the fuel injection pressure is reduced along with an increase in the nozzle hole area, and the injection period becomes short. As a result, the necessary flow of spray is supplied distributed uniformly overall and stable high-output fuel combustion is carried out. Also, because the rotary valve 7 is fixed with the fuel injection pressure only, a small, low-torque actuator can be used for the actuator 9 and it is thereby possible to avoid increasing the size of the fuel injection nozzle and facilitate its positioning and mounting on the engine.

When the rotary valve 7 moves out of position due to an outside force stronger than the holding force, this positional deviation is detected by the angle detecting mechanism 11 when the needle valve 4 has closed after the respective fuel injection. Because a feedback signal of this deviation is fed to the controller 12, it is corrected by driving of the actuator 9 by a signal from the controller 12, and the rotary valve 7 is thereby returned to the set angular position of the time of the previous injection and held in this state. Because it is possible to continually detect and correct the position of the rotary valve 7 in this way, variation in the spray from injection to injection can be reduced.

Also, since as described above it is possible to fix the position of the rotary valve 7 with the fuel injection pressure only, if the relationship between the holding torque $T_2$ on the rotary valve and the torque $T_1$ tending to rotate the rotary valve, i.e. $T_2-T_1$, is made small, by applying a small torque from outside just sufficient to overcome the difference $\Delta T$ between $T_2$ and $T_1$ it is possible to rotate the rotary valve 7 and change the opening area of the nozzle holes 35 even during fuel injection, and by this means it is possible to carry out injection rate control of pilot injections and the like easily.

Because the rotary valve 7 and the well 34 are surface-sealed by the conical surfaces 72, 341, so-called inter-nozzle hole fuel leakage wherein some fuel flows in the circumferential direction between the well 34 and the peripheral surface of the rotary valve 7 is prevented, and spraying with a correctly distributed spray amount is effected.

In this first preferred embodiment, because a conical surface 10*c* of the coupling 10 and a conical surface 451 of the first hole 45*a* are seated on each other, fixing of the rotary valve 7 is made even more certain by frictional force resulting from this. Also, surface sealing between the conical surfaces 10*c* and 451 prevents fuel from leaking upward around the connecting pin 8*b*. As a result, it is possible to effect spraying with the injection pressure held at the initial pressure.

When the channel bottoms of the fuel passages 73 of the rotary valve 7 are made parallel with the conical surface 72, as in FIG. 2 through FIG. 6 (first example), because compared to when the channel bottoms are made parallel with the nozzle axis, as shown in FIG. 7 and FIG. 8 (second example), it is possible to make the area of the pressure-receiving surface 74 larger, the holding torque on the rotary valve 7 can be made larger.

In the second preferred embodiment, control of the angular position of the rotary valve 7, i.e. selection of the nozzle holes 35, is carried out by a driving signal being fed from the controller to the actuator 9 during an intake stroke or an exhaust stroke of the engine cylinder and the output shaft of the actuator 9 being driven to a required angle according to the speed (or angle) and the load of the engine or the fuel injection pump and this being transmitted to the shaft proper 8*a*.

For example, during low-load and low-speed running on engine starting the rotary valve 7 is rotated to the position shown in FIG. 18-A and the fuel passages 73 (in this example the horizontal holes 730) are thereby respectively connected to the small-diameter first nozzle holes 35*a* and the second nozzle holes 35*b* are covered. During high load and high speed running of the engine the rotary valve 7 is rotated from the state shown in FIG. 18-A counterclockwise (or clockwise) as shown in FIG. 18-B and held in the state shown in FIG. 18-C, and the horizontal holes 730 of the fuel passages 73 are thereby respectively connected to the second nozzle holes 35*b* and the first nozzle holes 35*a* are covered.

As a result of the switching of nozzle holes described above, during low-load running the fuel injection pressure is increased along with reduction of the nozzle hole area and the fuel injection period lengthens. Consequently promotion of fine atomization of the spray and increase in the excess air ratio of the spray can be expected and NOx emissions are reduced. During high-load running the fuel injection pressure is reduced along with an increase in the nozzle hole area and the injection period shortens. As a result, the necessary flow of spray is supplied distributed uniformly overall and stable high-output fuel combustion is effected.

In this preferred embodiment also, the rotary valve 7 is not a column or a straight cylinder but has the conical surface 72 over a wide area, and the well 34 also has a conical surface 341 matching this conical surface 72. The nozzle holes 35 are disposed in this conical surface 341, and the ends of the fuel passages 73 open at the conical surface 72.

Consequently, during fuel injection, as a result of the fuel injection pressure acting on the pressure-receiving surface 74, the rotary valve 7 is firmly fixed and held in position by the frictional force resulting from the strong contact between the facing conical surfaces 341, 72.

As a result, the high-pressure fuel is injected through the selected nozzle holes 35 only. That is, in FIG. 18-A fuel is injected through the four small-diameter first nozzle holes 35*a* only and in FIG. 18-C fuel is injected through the four large-diameter second nozzle holes 35*b* only. Therefore, a spray based on the selected nozzle holes is formed precisely and it becomes possible to adjust the total nozzle hole area accurately, and by means of a precise spray based on the selected nozzle holes it is possible to realize reductions in NOx, smoke and HC and improvements in fuel economy.

In this second preferred embodiment also it is of course possible to reduce dispersion in spray from injection to injection by carrying out control of rotation of the rotary valve 7 according to the flow chart shown in FIG. 22, and it is also possible to switch nozzle holes or adjust the degree of opening of the selected nozzle holes to any size during injection.

When the connecting pin 8*b* has a large-diameter portion 80 moved up and down integrally with the needle valve 4, the large-diameter portion 80 functions as a surface sealing part. As a result, it is possible to prevent injection pressure reduction and injection amount deficiency on injection caused by leakage of fuel through the drive shaft arrangement.

In the first preferred embodiment and the second preferred embodiment, when the fuel passages 73 of the rotary valve 7 are made of the channel type shown in FIG. 6 through FIG. 8 and FIG. 21, there is the merit that machining of the fuel passages 73 is easy and it is possible to achieve cost reductions.

The invention can be used as a fuel injection nozzle for promoting fuel economy and improving output and fuel consumption and reducing combustion noise and NOx emissions in internal combustion engines typified by diesel engines.

What is claimed is:

1. A variable nozzle hole fuel injection nozzle having a well for guiding pressurized fuel formed in tip part of a nozzle body and a needle valve opened by a predetermined fuel pressure disposed on the entrance side of the well and a plurality of nozzle holes for spraying pressurized fuel provided spaced in the circumferential direction in an enclosing wall bounding the well and a rotary valve disposed inside the well, the rotary valve being rotated by an actuator to adjust the opening area of the nozzle holes, wherein the enclosing wall bounding the well has a conical surface and the nozzle holes open at this conical surface; the rotary valve has at its upper end a pressure-receiving surface for receiving the pressure of the pressurized fuel and has at its circumferential periphery a conical surface of an angle matching the angle of the conical surface of the enclosing wall and a plurality of fuel passages each having one end opening at the pressure-receiving surface are provided spaced in the circumferential direction in the rotary valve and the other ends of the fuel passages open at the conical surface of the rotary valve at the level of the nozzle holes; and the conical surface of the enclosing wall and the conical surface of the rotary valve have an angle such that between them arises a frictional holding torque overcoming a rotating torque tending to rotate the rotary valve in the circumferential direction resulting from injection pressure during fuel injection.

2. A variable nozzle hole fuel injection nozzle according to claim 1, wherein the diameters of the nozzle holes of the enclosing wall bounding the well are made the same and the openings of the fuel passages at the conical surface of the rotary valve have a size at least equal to the diameter of the nozzle holes and the degree of opening of the nozzle holes is changed gradually in correspondence with the amount of rotation of the rotary valve.

3. A variable nozzle hole fuel injection nozzle according to claim 1, wherein the nozzle holes in the enclosing wall bounding the well have at least two different diameters and are disposed so that adjacent nozzle holes have different diameters and the openings of the fuel passages at the conical surface of the rotary valve have a size at least equal to the diameter of the largest nozzle holes and the nozzle holes of the different diameters are selected by rotation of the rotary valve.

4. A variable nozzle hole fuel injection nozzle according to claim 1, wherein the fuel passages of the rotary valve are channels formed in the conical surface of the rotary valve extending from the pressure-receiving surface of the rotary valve.

5. A variable nozzle hole fuel injection nozzle according to claim 4, wherein the bottom surfaces of the channels are substantially parallel with the conical surface of the rotary valve.

6. A variable nozzle hole fuel injection nozzle according to claim 4, wherein the bottom surfaces of the channels are substantially parallel with the axis of the rotary valve.

7. A variable nozzle hole fuel injection nozzle according to claim 4, wherein the fuel passages of the rotary valve are holes.

8. A variable nozzle hole fuel injection nozzle according to claim 1, wherein the pressure-receiving surface of the rotary valve is connected by way of a coupling to a drive shaft arrangement and this drive shaft arrangement is driven by the actuator.

9. A variable nozzle hole fuel injection nozzle according to claim 8, wherein the coupling extends into and is connected to the drive shaft arrangement in a cavity in the tip of the needle valve and a conical surface is formed on the inside of the cavity of the needle valve and on this conical surface a conical surface of the coupling is seated.

10. A variable nozzle hole fuel injection nozzle having a well for guiding pressurized fuel formed in a tip part of a nozzle body and a needle valve opened by a predetermined fuel pressure disposed on the entrance side of the well and a plurality of nozzle holes for spraying pressurized fuel provided spaced in the circumferential direction in an enclosing wall bounding the well and a rotary valve disposed inside the well, the rotary valve being rotated by an actuator to adjust the opening area of the nozzle holes, wherein the enclosing wall bounding the well has a conical surface and the nozzle holes open at this conical surface and the rotary valve has at its upper end a pressure-receiving surface for receiving the pressure of the pressurized fuel and has at its circumferential periphery a conical surface of an angle matching the angle of the conical surface of the enclosing wall and a plurality of fuel passages each having one end opening at the pressure-receiving surface are provided spaced in the circumferential direction in the rotary valve and the other ends of the fuel passages open at the conical surface of the rotary valve at the level of the nozzle holes and a drive shaft arrangement connecting the rotary valve to the actuator has an angle detecting mechanism and the output side of this angle detecting mechanism is connected to a controller for driving the actuator and between fuel injections and/or during fuel injections the actuator is driven by a signal from the angle detecting mechanism and the angle of the rotary valve is corrected.

* * * * *